US010021501B2

(12) United States Patent
Adami et al.

(10) Patent No.: US 10,021,501 B2
(45) Date of Patent: Jul. 10, 2018

(54) CONCEPT FOR GENERATING A DOWNMIX SIGNAL

(71) Applicant: Fraunhofer-Gesellschaft zur Foerderung der angewandten Forschung e.V., Munich (DE)

(72) Inventors: Alexander Adami, Gundelsheim (DE); Emanuel Habets, Spardorf (DE); Juergen Herre, Erlangen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 15/080,584

(22) Filed: Mar. 25, 2016

(65) Prior Publication Data

US 2016/0212561 A1 Jul. 21, 2016

Related U.S. Application Data

(63) Continuation of application No. PCT/EP2014/068611, filed on Sep. 2, 2014.

(30) Foreign Application Priority Data

Sep. 27, 2013 (EP) ..... 13186480
Mar. 21, 2014 (EP) ..... 14161059

(51) Int. Cl.
*H04R 5/00* (2006.01)
*H04S 7/00* (2006.01)
*G10L 19/008* (2013.01)

(52) U.S. Cl.
CPC ..... *H04S 7/30* (2013.01); *G10L 19/008* (2013.01); *H04S 2400/03* (2013.01)

(58) Field of Classification Search
CPC . H04R 5/00; H04R 5/02; H04R 5/033; H04R 25/04; H04R 25/353; H04R 25/356;
(Continued)

(56) References Cited

U.S. PATENT DOCUMENTS 4,192,969 A * 3/1980 Iwahara ..... H04S 1/002 381/1
4,893,342 A * 1/1990 Cooper ..... H04S 1/005 381/26

(Continued)

FOREIGN PATENT DOCUMENTS

JP 2012073351 A 4/2012
JP 2013207487 A 10/2013

(Continued)

OTHER PUBLICATIONS

Chen, Der-Pei et al., "Audio Engineering Society Convention Paper 8067 Gram-Schmidt-based Downmix and Decorrelator in the MPEG Surround Coding", Retrieved from the Internet: URL:http://www.aes.org/tmpfiles/elib/20140909/15364.pdf (retrieved on Sep. 9, 2014), section 4.4. The GS-based Downmixer; p. 5, right-hand column; figure 3, May 22, 2010.

(Continued)

*Primary Examiner* — Leshui Zhang
(74) *Attorney, Agent, or Firm* — Perkins Coie LLP; Michael A. Glenn

(57) ABSTRACT

An audio signal processing device for downmixing of a first input signal and a second input signal to a downmix signal having:

a dissimilarity extractor configured to receive the first input signal and the second input signal as well as to output an extracted signal, which is lesser correlated with respect to the first input signal than the second input signal and (Continued)

a combiner configured to combine the first input signal and the extracted signal in order to obtain the downmix signal.

18 Claims, 9 Drawing Sheets

(58) Field of Classification Search
CPC ..... H04R 25/40; H04R 25/407; H04R 25/45; H04R 25/453; H04R 25/456; H04R 25/502; H04R 25/505; H04R 2227/003; H04R 2227/005; H04R 27/00; H04R 3/12; H04R 2420/01; H04R 25/43; H04H 20/47; H04H 20/48; H04H 20/49; H04H 20/88; H04H 40/36; H04H 40/45; H04H 40/54; H04H 40/81; H04H 40/72; H04H 20/61; H04S 1/00; H04S 1/002; H04S 1/005; H04S 1/007; H04S 3/00; H04S 3/02; H04S 3/002; H04S 3/004; H04S 5/00; H04S 5/005; H04S 5/02; H04S 7/00; H04S 7/30; H04S 7/301; H04S 2400/01; G10H 1/16; H03G 3/00; H04B 3/20; H04B 3/00; H04B 1/00; H04B 1/082
USPC ..... 381/1–23, 302, 303, 307, 309–311, 27, 381/317, 320, 321, 77, 78, 79, 80, 81, 86, 381/334, 119, 101, 102, 103, 104, 106, 381/110, 61; 704/239, 216, 217, 218, 704/237, 263, E19.005; 700/94
See application file for complete search history.

(56) References Cited

U.S. PATENT DOCUMENTS

| | | | | | |
|---|---|---|---|---|---|
| 4,975,954 | A * | 12/1990 | Cooper | H04S 1/002 | 381/1 |
| 5,715,319 | A * | 2/1998 | Chu | H04R 3/005 | 381/26 |
| 5,740,256 | A * | 4/1998 | Castello Da Costa | H04B 7/015 | 381/94.7 |
| 5,982,903 | A * | 11/1999 | Kinoshita | H04S 1/005 | 381/17 |
| 6,134,211 | A * | 10/2000 | Miyanabe | G11B 20/22 | 369/124.02 |
| 6,243,476 | B1 * | 6/2001 | Gardner | H04S 1/007 | 381/1 |
| 7,039,204 | B2 | 5/2006 | Baumgarte et al. | | |
| 8,867,753 | B2 | 10/2014 | Neusinger et al. | | |
| 9,514,759 | B2 * | 12/2016 | Virette | G10L 19/008 | |
| 2005/0157883 | A1 * | 7/2005 | Herre | G10L 19/008 | 381/17 |
| 2009/0245335 | A1 * | 10/2009 | Fang | H04B 3/32 | 375/222 |
| 2010/0094631 | A1 * | 4/2010 | Engdegard | G10L 19/008 | 704/258 |
| 2011/0264456 | A1 * | 10/2011 | Koppens | G10L 19/008 | 704/500 |
| 2012/0014526 | A1 | 1/2012 | Stoll et al. | | |
| 2012/0020499 | A1 * | 1/2012 | Neusinger | G10L 19/008 | 381/119 |
| 2012/0070007 | A1 * | 3/2012 | Kim | G10L 21/038 | 381/22 |

FOREIGN PATENT DOCUMENTS

| | | | |
|---|---|---|---|
| RU | 2439719 | C2 | 1/2012 |
| WO | 0060746 | A2 | 10/2000 |
| WO | 2009049895 | A1 | 4/2009 |
| WO | 2010115850 | A1 | 10/2010 |
| WO | 2012109384 | A1 | 8/2012 |

OTHER PUBLICATIONS

Dressler, R. , "Dolby Surround Pro Logic II Decoder Principles of Operation", (online). Available: http://www.dolby.com/uploadFiles/Assets/US/Doc/Professional/209_Dolby_Surround_Pro_Logic_II_Decoder_Principles_of_Operation.pdf., May 8, 2004, 8 pages.

Faller, Christof et al., "Binaural Cue Coding—Part II: Schemes and applications", IEEE Transactions on speech and audio processing, vol. 11, No. 6, Nov. 2003, pp. 520-531.

Herre, Juergen et al., "MPEG Surround—The ISO/MPEG Standard for Efficient and Compatible Multichannel Audio Coding", J. Audio Eng. Soc., vol. 56, No. 11., Nov. 2008, pp. 932-955.

ITU-R, , "Multichannel Stereophonic Sound System With and Without Accompanything Picture", International Telecommunication Union/ Rec. ITU-R BS.775-2, 2010, pp. ii-11.

Kim, Miyoung et al., "Stero Audio Coding Improved by Phase Parameters", Audio Engineering Society Convention Paper 8289. Presented at the 129th Convention 2010 Nov. 4-7, San Francisco, CA, USA, Nov. 4, 2010, pp. 1-6.

Lopatka, Kuba et al., "Novel 5.1 Downmix Algorithm With Improved Dialogue Intelligibility", Audio Engineering Society Convention Paper 8831, Presented at the 134th Convention May 4-7, 2013 Rome, Italy, May 4, 2013, pp. 1-14.

Neuendorf, Max et al., "MPEG Unified Speech and Audio Coding—The ISO/MPEG Standard for High-Efficiency Audio Coding of all Content Types", Audio Engineering Society Convention Paper, Presented at the 132nd Convention Apr. 26-29, 2012, Budapest, Hungary, Apr. 26, 2012, pp. 1-22.

Runow, Bernfried et al., "An Optimized Stereo-Downmix of a 5.1 Multichannel Audio Production", Tonmeistertagung—VDT International Convention, Nov. 2008, 2008, 9 pages.

Samsudin, "A Stereo to Mono Downmixing Scheme for MPEG-4 Parametric Stereo Encoder", School of Electrical and Electronic Engineering, Nanyang Technological University, Singapore, STMicroelectronics Asia Pacific Pte. Ltd., IEEE, 2006, V-529-V-532.

Thompson, Jeffrey et al., "An Active Multichannel Downmix Enhancement for Minimizing Spatial and Spectral Distortions", Audio Engineering Society Convention Paper, Presented at the 127th Convention Oct. 9-12, 2009, New York, NY, USA, Oct. 9, 2016, pp. 1-7.

Wu, Wenhai et al., "Parametric Stereo Coding Scheme with a New Downmix Method and Whole Band Inter Channel Time/Phase Differences", Hauwei Technologies, China, Huawei European Research Center, Germany, IEEE 2013, 2013, pp. 556-560.

Hyun, Dongil et al., "Robust Interchannel Correlation (ICC) Estimation Using Constant Interchannel Time Difference (ICTD) Compensation", Audio Engineering Society Convention 127. Oct. 12, 2009 : http://www.aes.org/e-lib/browse.cfm?elib=15129, Oct. 1, 2009.

Kim, Junghoe et al., "Enhanced Stereo Coding with Phase Parameters for MPEG Unified Speech and Audio Coding", Audio Engineering Society Convention 127. Oct. 12, 2009 http://www.aes.org/e-lib/browse.cfm?elib=15070, Oct. 1, 2009.

* cited by examiner

CONCEPT FOR GENERATING A DOWNMIX SIGNAL

CROSS-REFERENCE TO RELATED APPLICATIONS

This application is a continuation of copending International Application No. PCT/EP2014/068611, filed Sep. 2, 2014, which is incorporated herein by reference in its entirety, and additionally claims priority from European Application No. EP13186480.3, filed Sep. 27, 2013, and from European Application No. EP14161059.2, filed Mar. 21, 2014, which are also incorporated herein by reference in their entirety.

BACKGROUND OF THE INVENTION

The present invention is related to audio signal processing and, in particular, to downmixing of a plurality of input signals to a downmix signal.

In signal processing, it often it necessitated to mix two or more signals to one sum signal. The mixing procedure usually comes along with some signal impairments, especially if two signals, which are to be mixed, contain similar but phase shifted signal parts. If those signals are summed up, the resulting signal contains severe comb-filter artifacts. To prevent those artifacts, different methods have been suggested being either very costly in terms of computational complexity or based on applying a correction gain or term to the already impaired signal.

Converting multi-channel audio signals into a fewer number of channels normally implies mixing several audio channels. The ITU, for instance, recommends using a time-domain, passive mix matrix with static gains for a downward conversion from a certain multi-channel setup to another [1]. In [2] a quite similar approach is proposed.

To increase dialogue intelligibility, a combined approach of using the ITU-based and a matrix-based downmix is proposed in [3]. Also, audio coders utilize a passive downmix of channels, e.g. in some parametric modules [4, 5, 6].

The approach described in [7] performs a loudness measurement of every input and output channel, i.e. of every single channel before and after the mixing process. By taking the ratio of the sum of the input energies (i.e. energy of the channels supposed to be mixed) and the output energy (i.e. energy of the mixed channels), gains can be derived such that signal energy loss and coloration effects are reduced.

The approach described in [8] performs a passive downmix which is afterwards transformed into frequency domain. The downmix is then analyzed by a spatial correction stage which tries to detect and correct any spatial inconsistencies through modifications to the inter-channel level differences and inter-channel phase differences. Then, an equalizer is applied to the signal to ensure the downmix signal has the same power as the input signal. In the last step, the downmix signal is transformed back into time domain.

A different approach is disclosed in [9, 10], where two signals, which are to be downmixed, are transformed into frequency domain and a desired/actual value pair is built. The desired value calculates as the root of the sum of the single energies, whereas the actual value computes as the root of energy of the sum signal. The two values are then compared and depending on the actual value being greater or less than the desired value, a different correction is applied to the actual value.

Alternatively, there are methods which aim on aligning the signals' phases, such that no signal cancelation effects occur due to phase differences. Such methods were proposed for instance for parametric stereo encoders [11, 12, 13].

A passive downmix as done in [1, 2, 3, 4, 5, 6] is the most straight forward approach to mix signals. But if no further action is taken, the resulting downmix signals might suffer from severe signal loss and comb-filtering effects.

The approaches described in [7, 8, 9, 10] perform a passive downmix, in the sense of equally mixing both signals, in the first step. Afterwards, some corrections are applied to the downmixed signal. This might help to reduce comb-filter effects, but on the other hand will introduce modulation artifacts. This is caused by rapidly changing correction gains/terms over time. Furthermore, a phase shift of 180 degrees between the signals to be downmixed still results in a zero value downmix and cannot be compensated for by applying, for instance, a correction gain.

A phase-align approach, such as mentioned in [11, 12, 13], may help to avoid unwanted signal cancelation; but due to still performing a simple add-up procedure of the phase-aligned signals comb-filter and cancelation may occur if phases are not estimated properly. Additionally, robustly estimating the phase relations between two signals is not an easy task and is computational intensive, especially if done for more than two signals.

SUMMARY

According to an embodiment, an audio signal processing device for downmixing of a first input signal and a second input signal to a downmix signal, wherein the first input signal and the second input signal are at least partly correlated, may have: a dissimilarity extractor configured to receive the first input signal and the second input signal as well as to output an extracted signal, which is lesser correlated with respect to the first input signal than the second input signal and a combiner configured to combine the first input signal and the extracted signal in order to obtain the downmix signal, wherein the dissimilarity extractor has a similarity estimator configured to provide filter coefficients for obtaining signal parts of the first input signal being present in the second input signal from the first input signal, wherein the dissimilarity extractor has a similarity reducer configured to reduce the obtained signal parts of the first input signal being present in the second input signal based on the filter coefficients, wherein the similarity reducer has a signal suppression stage having a signal suppression device configured to multiply the second input signal or a signal derived from the second input signal with a suppression gain factor in order to obtain the extracted signal, wherein the suppression gain factor is chosen in such way that a mean squared error between the extracted signal and a signal part of the second input signal, which is uncorrelated with the first input signal, is minimized.

Another embodiment may have an audio signal processing system for downmixing of a plurality of input signals to a downmix signal having at least a first device as mentioned above and a second device as mentioned above, wherein the downmix signal of the first device is fed to the second device as a first input signal or as a second input signal.

According to another embodment, a method for downmixing of a first input signal and a second input signal to a downmix signal may have the steps of: extracting an extracted signal from the second input signal, wherein the extracted signal is lesser correlated with respect to the first input signal than the second input signal, summing up the first input signal and the extracted signal in order to obtain the downmix signal, providing filter coefficients for obtaining signal parts of the first input signal being present in the second input signal from the first input signal, reducing the obtained signal parts of the first input signal being present in the second input signal based on the filter coefficients, multiplying the second input signal or a signal derived from the second input signal with a suppression gain factor in order to obtain the extracted signal, wherein the suppression gain factor is chosen in such way that a mean squared error between the extracted signal and a signal part of the second input signal, which is uncorrelated with the first input signal, is minimized.

Another embodiment may have a computer program for implementing the above method when being executed on a computer or signal processor.

An audio signal processing device for downmixing of a first input signal and a second input signal to a downmix signal, wherein the first input signal ($X_1$) and the second input signal ($X_2$) are at least partly correlated, comprising:

a dissimilarity extractor configured to receive the first input signal and the second input signal as well as to output an extracted signal, which is lesser correlated with respect to the first input signal than the second input signal and a combiner configured to combine the first input signal and the extracted signal in order to obtain the downmix signal is provided.

The device will be described herein in time-frequency domain, but all considerations are also true for time domain signals. A first input signal and second input signal are the signals to be mixed, where the first input signal serves as reference signal. Both signals are fed into a dissimilarity extractor, where correlated signal parts of the second input signal with respect to the second input signal are rejected and only the uncorrelated signal parts of the second input signal are passed to the extractor's output.

The improvement of the proposed concept lies in the way the signals are mixed. In the first step, one signal is selected to serve as a reference. It is then determined, which part of the reference signal is already present within the other, and only those parts, which are not present in the reference signal (i.e. the uncorrelated signal), are added to the reference to build the downmix signal. Since only low-correlated or uncorrelated signal parts with respect to the reference are combined with the reference, the risk of introducing comb-filter effects is minimized.

As a summary, a novel concept of mixing two signals to one downmix signal is proposed. The novel method aims at preventing the creation of downmix artifacts, like comb-filtering. In addition, the proposed method is computationally efficient.

In some embodiments of the invention the combiner comprises an energy scaling system configured in such way that the ratio of the energy of the downmix and the summed up energies of the first input signal and the second input signal is independent from the correlation of the first input signal and the second input signal. Such energy scaling device may ensure that the downmixing process is energy preserving (i.e., the downmix signal contains the same amount of energy as the original stereo signal) or at least that the perceived sound stays the same independently from the correlation of the first input signal and the second input signal.

In embodiments of the invention the energy scaling system comprises a first energy scaling device configured to scale the first input signal based on a first scale factor in order to obtain a scaled input signal.

In some embodiments of the invention the energy scaling system comprises a first scale factor provider configured to provide the first scale factor, wherein the first scale factor provider may be designed as a processor configured to calculate the first scale factor depending on the first input signal, the second input signal, the extracted signal and/or a scale factor for the extracted signal. During the downmixing, the reference signal (first input signal) might be scaled to preserve the overall energy level or to keep the energy level independent from the correlation of the input signals automatically.

In embodiments of the invention the energy scaling system comprises a second energy scaling device configured to scale the extracted signal based on a second scale factor in order to obtain a scaled extracted signal.

In some embodiments of the invention the energy scaling system comprises a second scale factor provider configured to provide the second scale factor, wherein the second scale factor provider may be designed as a man-machine interface configured for manually inputting the second scale factor.

The second scale factor can be seen as an equalizer. In general, this may be done frequency dependent and in advantageous embodiments manually by a sound engineer. Of course, plenty of different mixing ratios are possible and these highly depend on the experience and/or taste of the sound engineer.

Alternatively, the second scale factor provider may be designed as a processor configured to calculate the first scale factor depending on the first input signal, the second input signal and/or the extracted signal.

In some embodiments of the invention the combiner comprises a sum up device for outputting the downmix signal based on the first input signal and based on the extracted signal. Since only low-correlated or even uncorrelated signal parts with respect to the reference are added to the reference, the risk of introducing comb-filter effects is minimized. In addition, the use of a sum up device is computationally efficient.

In some embodiments of the invention the dissimilarity extractor comprises a similarity estimator configured to provide filter coefficients for obtaining the signal parts of the first input signal being present in the second input signal from the first input signal and a similarity reducer configured to reduce the signal parts of the first input signal being present in the second input signal based on the filter coefficients. In such implementations, the dissimilarity extractor consists of two sub-stages: a similarity estimator and a similarity reducer. The first input signal and the second input signal are fed into a similarity estimation stage, where the signal parts of the first input signal being present within the second input signal are estimated and represented by the resulting filter coefficients. The filter coefficients, the first input signal and the second input signal are fed into the similarity reducer where the signal parts of the second input signal being similar to the first input signal are suppressed and/or canceled, respectively. This results in the extracted signal which is an estimation for the uncorrelated signal part of the second input signal with respect to the first input signal.

In some embodiments of the invention the similarity reducer comprises a cancelation stage having a signal cancellation device configured to subtract the obtained signal parts of the first input signal being present in the second input signal or a signal derived from the obtained signal parts from the second input signal or from a signal derived from the second input signal. This concept is related to a method being used in the subject of adaptive noise cancelation but with the difference that it is not used, as originally intended, to cancel the noise or uncorrelated component but instead to cancel the correlated signal part, which results in the extracted signal.

In some embodiments of the invention the cancelation stage comprises a complex filter device configured to filter the first input signal by using complex valued filter coefficients. The advantage of this approach is that phase shifts can be modeled.

In some embodiments of the invention the cancelation stage comprises a phase shift device configured to align the phase of the second input signal to the phase of the first input signal. For opposite phases between the first input signal and the second input signal in addition with sudden signal drops of the first input signal, phase jumps and signal cancelation effects may occur within the downmix signal. This effect can be drastically reduced by aligning the phase of the second input signal towards the first input signal. Such cancelation stage may be called reverse phase aligned cancelation stage.

In some embodiments of the invention the similarity reducer comprises a signal suppression stage having a signal suppression device configured to multiply the second input signal with a suppression gain factor in order to obtain the extracted signal. It has been observed that audible distortions due to estimation errors in the filter coefficients may be reduced by these features.

In some embodiments of the invention the signal suppression stage comprises a phase shift device configured to align the phase of the second input signal to the phase of the first input signal. The suppression gain factors are real-valued and therefore have no influence on the phase relations of the two input signals, but since the complex valued filter coefficients have to be estimated anyway, additional information on the relative phase between the input signals may be obtained. This information can be used to adjust the phase of the second input signal towards the first input signal. This may be done within the signal suppression stage before the suppression gains are applied, wherein the phase of the second input signal is shifted by the estimated phase of the complex valued filter factors mentioned above. Such suppression stage may be called reverse phase aligned suppression stage.

In some embodiments of the invention an output signal of the cancellation stage is fed to an input of the signal suppression stage in order to obtain the extracted signal or an output signal of the signal suppression stage is fed to an input of the cancellation stage in order to obtain the extracted signal. A combined approach of using canceling as well as suppression of coherent signal components may be used to further increase the quality of the downmix signal. The resulting downmix signal may be obtained by performing a cancelation procedure first, and afterwards applying a suppression procedure. In other embodiments, the resulting downmix signal may be obtained by performing a suppression procedure first, and afterwards applying a cancelation procedure. In this way, signal parts in the extracted signal, which are correlated to the first signal, may be further reduced. The extracted signal as well as the first input signal may be energy scaled as before.

In some embodiments of the invention the signal parts of the first input signal being present in the second input signal are being weighted before being subtracted from the second input signal depending on a weighting factor. A weighting factor may in general be time and frequency dependent but can also be chosen as constant. In some embodiments, the reverse phase-aligned cancelation module can be used here as well with a small modification: the weighting with the weighting factor has to be done analogously after filtering with the absolute value of the filter coefficients.

In some embodiments of the invention the phase shift device is configured to align the phase of the second input signal to the phase of the first input signal depending on the weighting factor.

In some embodiments of the invention the phase shift device is configured to align the phase of the second input signal to the phase of the first input signal only, if the weighting factor is smaller or equal to a predefined threshold.

The invention further relates to an audio signal processing system for downmixing of a plurality of input signals to a downmix signal comprising at least a first device according to the invention and a second device according to the invention, wherein the downmix signal of the first device is fed to the second device as a first input signal or as a second input signal. To downmix a plurality of input channels, a cascade of a plurality of two-channel downmix devices can be used.

Moreover, the invention relates to a method for downmixing of a first input signal and a second input signal to a downmix signal comprising the steps of:

estimating an uncorrelated signal, which is a component of the second input signal and which is uncorrelated with respect to the first input signal and summing up the first input signal and the uncorrelated signal in order to obtain the downmix signal.

Furthermore, the invention relates to a computer program for implementing the method according to the invention when being executed on a computer or signal processor.

BRIEF DESCRIPTION OF THE DRAWINGS

Embodiments are subsequently discussed with respect to the accompanying drawings, in which.

DETAILED DESCRIPTION OF THE INVENTION

Figure 1:
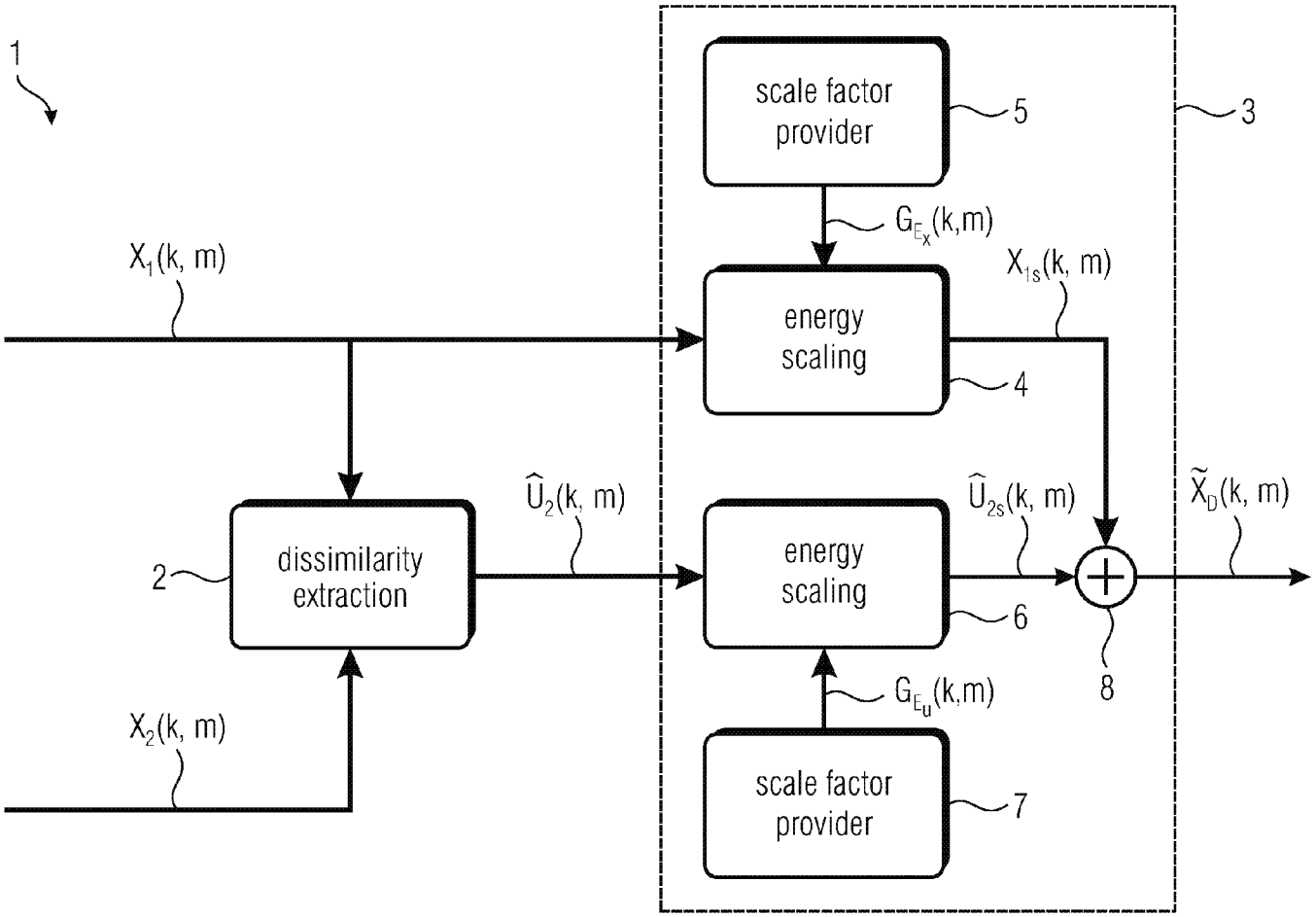
FIG. 1 illustrates a first embodiment of an audio signal processing device.

FIG. 1 shows a high level system description of the proposed novel downmix device 1. The device is described in time-frequency domain, where k and m correspond to frequency and time indices respectively, but all considerations are also true for time domain signals. A first input signal $X_1(k,m)$ and second input signal $X_2(k,m)$ are the input signals to be mixed, where the first input signal $X_1(k,m)$ may serve as reference signal. Both signals $X_1(k,m)$ and $X_2(k,m)$ are fed into a dissimilarity extractor 2, where correlated signal parts with respect to $X_1(k,m)$ and $X_2(k,m)$ are rejected or at least reduced and only the uncorrelated signal or the low-correlated parts $\hat{U}_2(k,m)$ are extracted and passed to the extractor's output. Then, the first input signal $X_1(k,m)$ is scaled using a first energy scaling device 4 to meet some predefined energy constraint, which results in a scaled reference signal $X_1(k,m)$ The necessitated scale factors $G_{E_x}(k,m)$ are provided by the scale factor provider 5. The extracted signal part $\hat{U}_2(k,m)$ can also be scaled using a second energy scaling device 6, which results in a scaled uncorrelated signal part $\hat{U}_{2s}(k,m)$. The corresponding scale factors $G_{E_u}(k,m)$ are provided by the second scale factor provider 7. The scale factors $G_{E_u}(k,m)$ may be determined advantageously manually by a sound engineer. Both scaled signals $X_{1s}(k,m)$ and $\hat{U}_{2s}(k,m)$ are summed up using a sum up device 8 to form the desired downmix signal $\tilde{X}_D(k,m)$.

Figure 2:
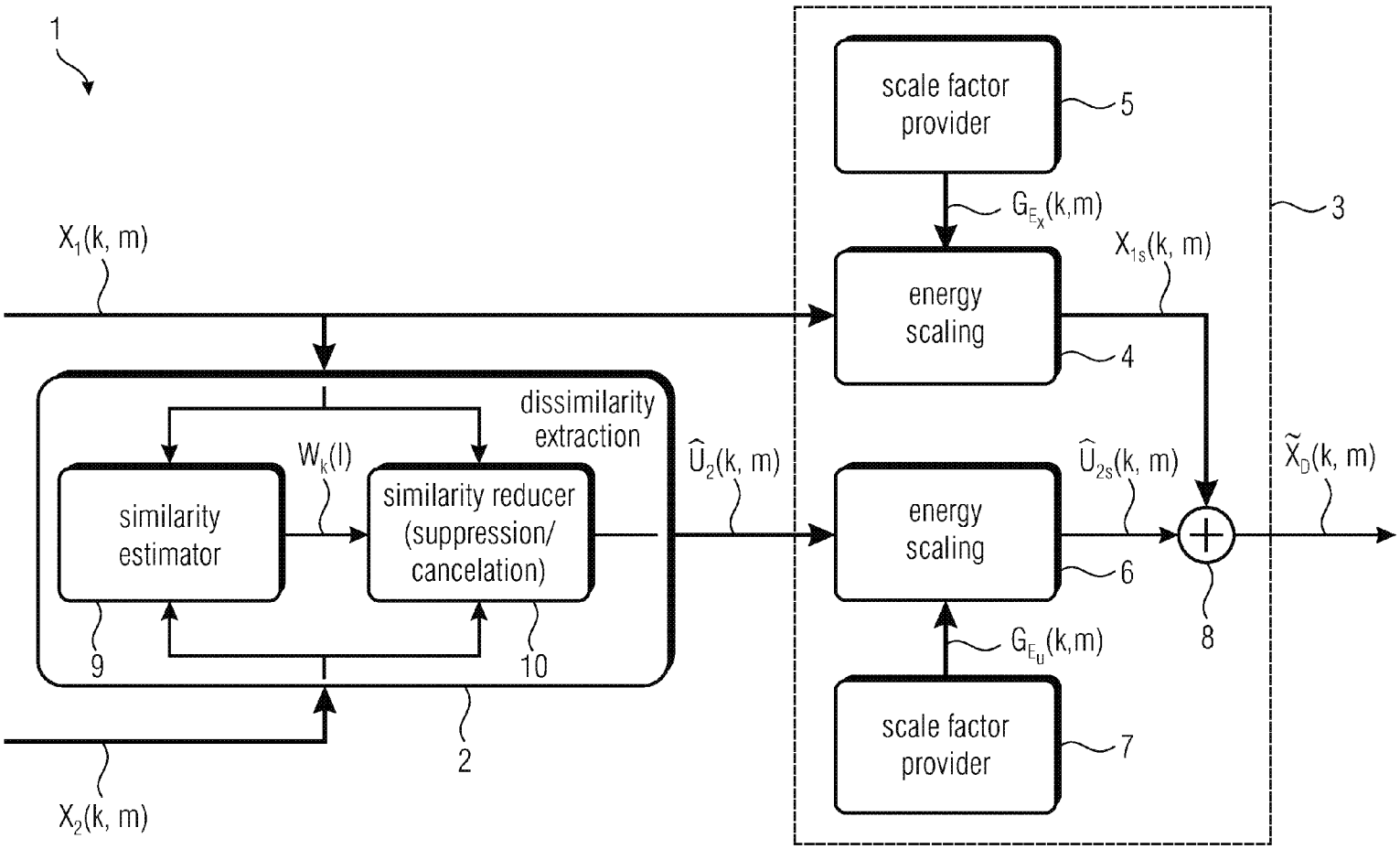
FIG. 2 illustrates the first embodiment in more details.

FIG. 2 shows a medium level system description of the proposed device 1. In some implementations, the dissimilarity extractor 2 consists of two sub-stages: a similarity estimator 9 and a similarity reducer 10 as depicted in FIG. 2. The first input signal $X_1(k,m)$ and the second input signal $X_2(k,m)$ are fed into a similarity estimation stage 9, where the signal parts of $X_1(k,m)$ being present within $X_2(k,m)$ are estimated and represented by the resulting filter coefficients $W_k(l)$ with l=0 . . . L−1 and L being the filter length. The filter coefficients $W_k(l)$, the first input signal $X_1(k,m)$ and the second input signal $X_2(k,m)$ are fed into the similarity reducer 10, where the signal parts of $X_2(k,m)$ being similar to $X_1(k,m)$ are at least partly suppressed and/or canceled, respectively. This results in the residual signal $\hat{U}_2(k,m)$, which is an estimation for the uncorrelated signal part of $X_2(k,m)$ with respect to $X_1(k,m)$.

The signal model assumes the second input signal $X_2(k,m)$ to be a mixture of a weighted or filtered version $W'(k,m)X_1(k,m)$ of the first input signal $X_1(k,m)$ and an initially unknown independent signal $U_2(k,m)$ with $E\{X_1U_2^*\}=0$. Thus, $X_2(k,m)$ is considered to consist of the sum of a correlated and an uncorrelated signal part with respect to $X_1(k,m)$:

$$X_2(k,m)=W'(k,m)\cdot X_1(k,m)+U_2(k,m). \tag{1}$$

Capital letters indicate frequency transformed signals and k and m are the frequency and time indices respectively. Now the desired downmix signal $\tilde{X}_D(k,m)$ can be defined as:

$$\tilde{X}_D(k,m)=G_{E_x}(k,m)X_1(k,m)+G_{E_u}(k,m)\hat{U}_2(k,m) \tag{2}$$

where $\hat{U}_2(k,m)$ is an estimation of $U_2(k,m)$ and where $G_{E_x}(k,m)$ and $G_{E_u}(k,m)$ are scaling factors to adjust the energies of the reference signal $X_1(k,m)$ and the extracted signal part $\hat{U}_2(k,m)$ of the other input signal $X_2(k,m)$ according to predefined constraints. Additionally, they can be used to equalize the signals. In some scenarios this might be necessitated, especially for $\hat{U}_2(k,m)$. In the remainder of this paper the time-frequency indices (k,m) will be omitted for clarity.

The paramount objective is to obtain the signal component $U_2$, which is uncorrelated with $X_1$. This can be done by utilizing a method being used in the subject of adaptive noise cancelation but with the difference that it is not used, as originally intended, to cancel the noise or uncorrelated component, but instead the correlated signal part, which results in the estimate $\hat{U}_2$ of $U_2$.

Figure 3:
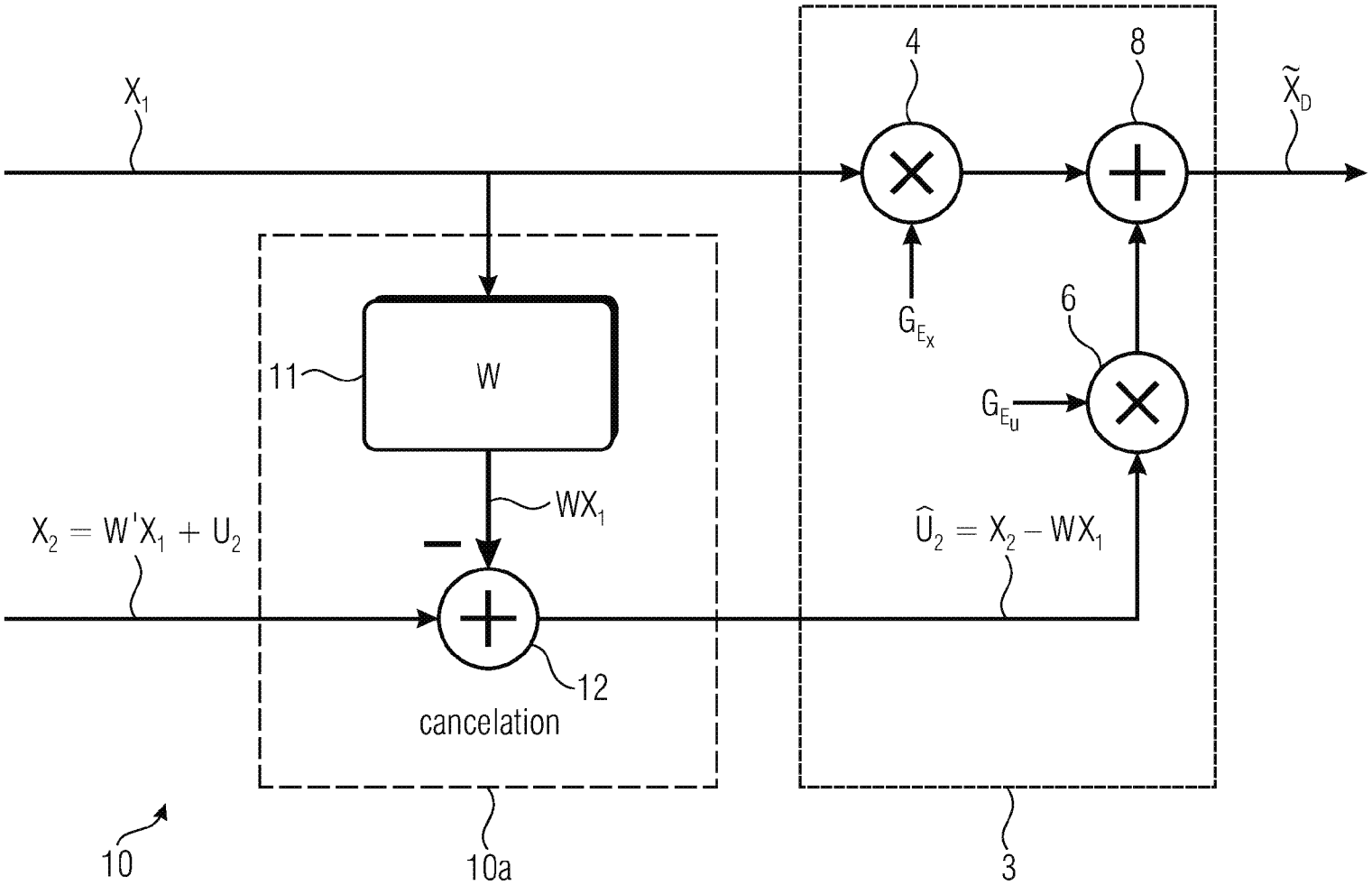
FIG. 3 illustrates a similarity reducer and a combiner of the first embodiment.

FIG. 3 depicts a similarity reducer 10 having a cancelation stage 10*a* and a combiner 3 of the first embodiment of such a system. The advantage of this approach is that W is allowed to be complex and thus phase shifts can be modeled.

$$\hat{U}_2=X_2-WX_1 \tag{3}$$

To determine $\hat{U}_2$, an estimated complex gain W for the initially unknown complex gain W' is needed. This is done by minimizing the energy of the extracted signal $\hat{U}_2$ in the minimum mean squared (MMS) sense:

$$\begin{aligned} J(W) &= E\{|X_2-WX_1|^2\} \\ &= E\{(X_2-WX_1)(X_2-WX_1)^*\} \\ &= E\{X_2X_2^*-X_2W^*X_1^*-WX_1X_2^*+WX_1W^*X_1^*\} \end{aligned} \tag{4}$$

Setting the partial derivative of J(W) with respect to W* to zero leads to the desired filter coefficients, i.e.:

$$\frac{\partial}{\partial W^*}J(W)=E\{X_2X_1^*\}-WE\{|X_1|^2\}\stackrel{!}{=}0 \tag{5}$$

$$\Rightarrow W=\frac{E\{X_2X_1^*\}}{E\{|X_1|^2\}}. \tag{6}$$

Figure 4:
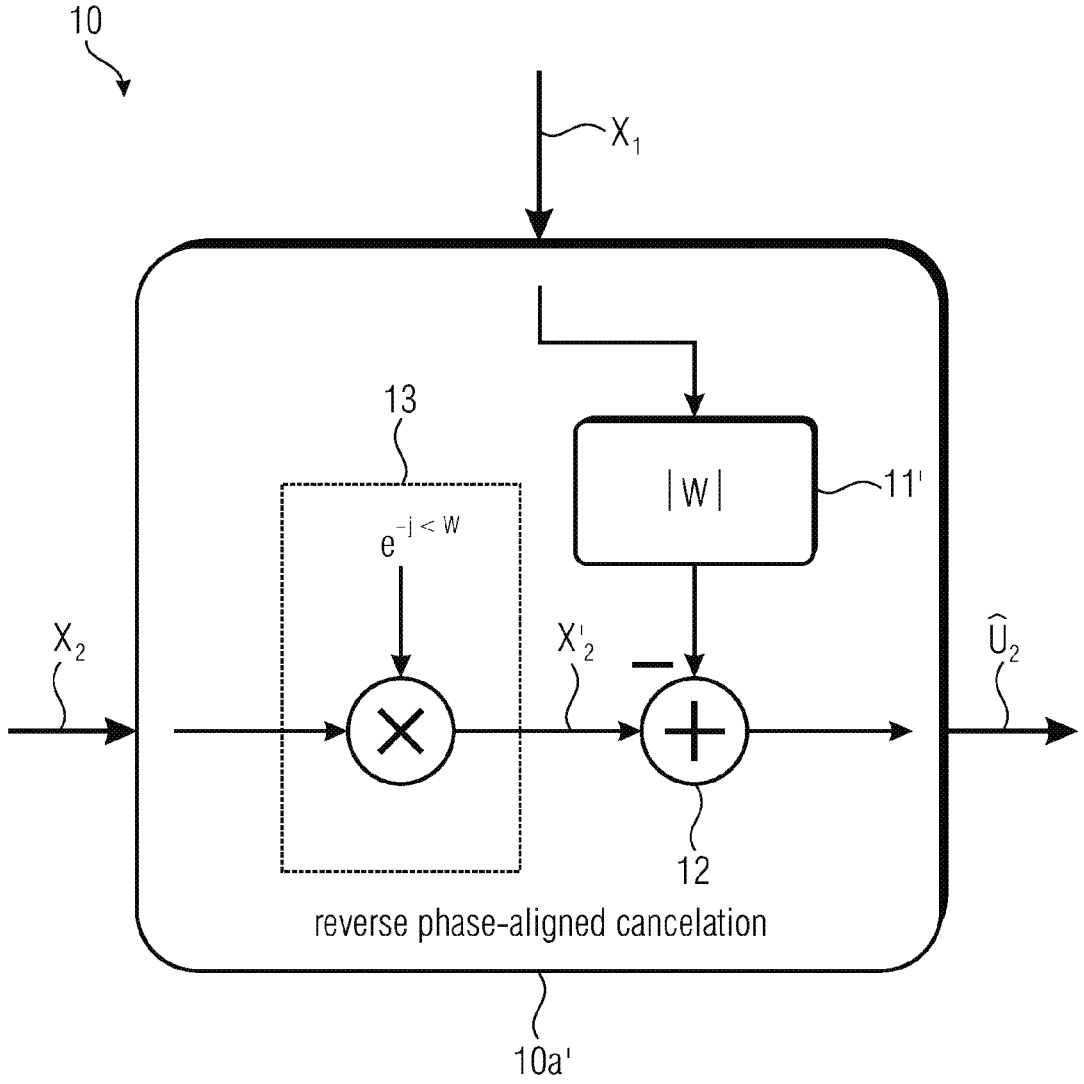
FIG. 4 illustrates a similarity reducer of a second embodiment.

In one embodiment, the cancelation module 10*a*, highlighted by the gray dashed rectangle in FIG. 3, can be replaced by a reverse phase-aligned cancelation block 10*a'* as depicted in FIG. 4, wherein the cancelation stage 10*a'* comprises a phase shift device 13 configured to align the phase of the second input signal $X_2$ to the phase of the first input signal $X_1$ and an absolute filter device 11' configured to filter an aligned first input signal ($X'_2$ by using absolute valued filter coefficients |W|.

For opposite phase of the first input signal $X_1$ and the second input signal $X_2$ in addition with sudden signal drops of the first input signal $X_1$, phase jumps and signal cancelation effects may occur within the downmix signal $\tilde{X}_D$. This effect can be drastically reduced by aligning the phase of the second input signal $X_2$ towards the phase of the first input signal $X_1$. Furthermore, just the absolute value of W is used to perform the filtering of $X_1$ and hence the cancelation too.

Figure 5:
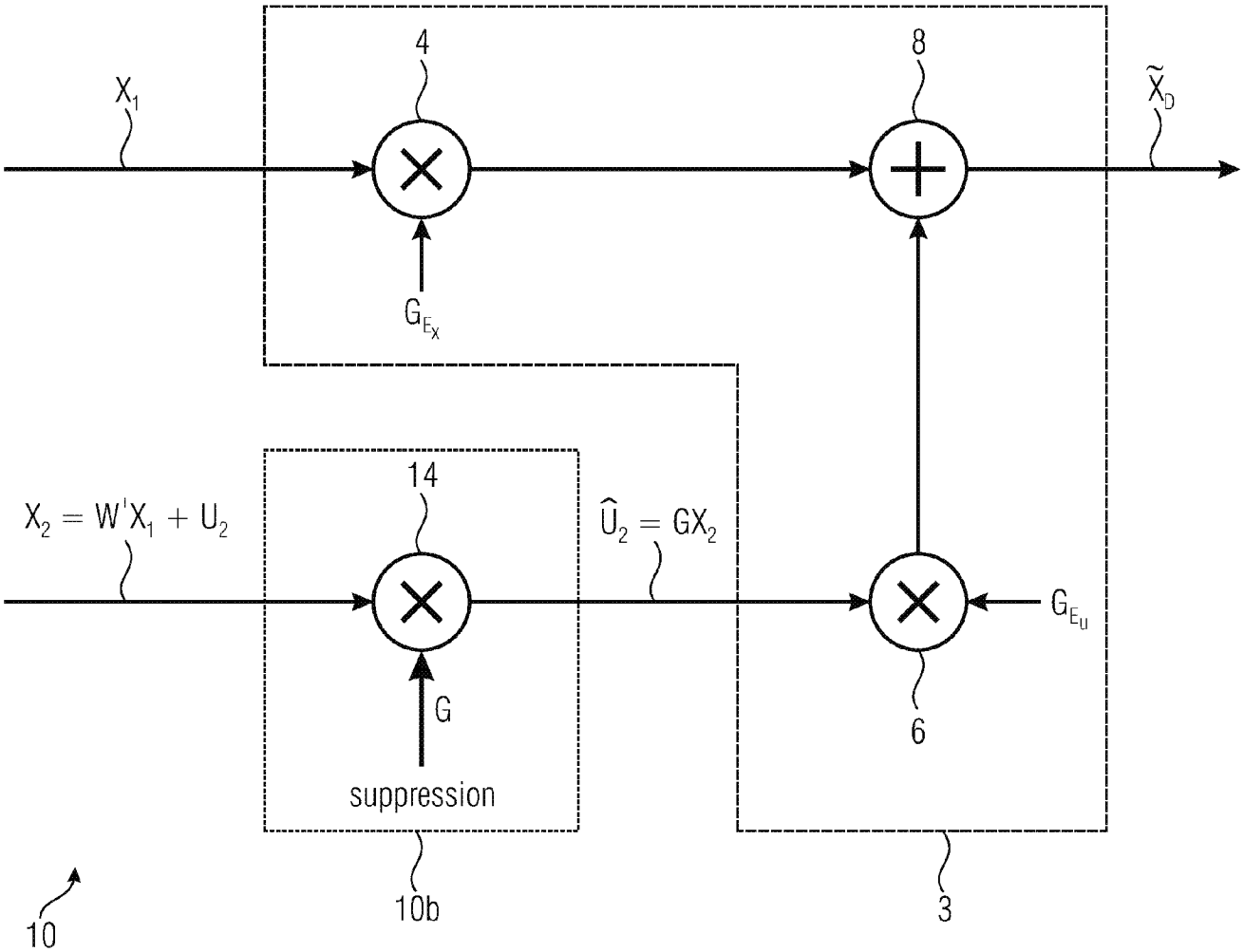
FIG. 5 illustrates a similarity reducer and a combiner of a third embodiment.

FIG. 5 illustrates a similarity reducer 10 and a combiner 3 of a third embodiment, wherein the similarity reducer 10 comprises a signal suppression stage 10*b* having a signal suppression device 14 configured to multiply the second input signal $X_2$ with a suppression gain factor (G) in order to obtain the extracted signal $\hat{U}_2$.

In practice, the extracted signal $\hat{U}_2$ obtained using (3) might contain audible distortions due to estimation errors in the complex gain W. As an alternative, an estimator 9 (see FIG. 2) to obtain an estimate $\hat{U}_2$ of $U_2$ in the minimum mean squared error (MMSE) sense may be derived. FIG. 5 shows a blockdiagram of the proposed approach.

The extracted signal $\hat{U}_2$ is then given by $$G=\underset{G}{\operatorname{argmin}}E\{|U_2-\hat{U}_2|^2\} \qquad G\in R \tag{8}$$

$$\begin{aligned} J(G) &= E\{|U_2-\hat{U}_2|^2\} \\ &= E\{|U_2-GX_2|^2\} \\ &= E\{|U_2-GWX_1-GU_2|^2\} \\ &= E\{(U_2-GWX_1-GU_2)(U_2-GWX_1-GU_2)^*\} \\ &= E\{|U_2|^2\}-GE\{|U_2|^2\}+G^2E\{|WX_1|^2\}-GE\{|U_2|^2\}+G^2E\{|U_2|^2\} \\ &= \Phi_{U_2}(1-2G+G^2)+G^2\Phi_{WX_1} \end{aligned} \tag{9}$$

Setting the partial derivative of J(G) with respect to G to zero leads to the desired gains:

$$\frac{\partial}{\partial G}J(G) = \Phi_{U_2}(-2+2G) + 2G\Phi_{WX_1} \overset{!}{=} 0 \tag{10}$$

$$\begin{aligned} &2\Phi_{U_2}(-1+G) + 2G\Phi_{WX_1} = 0 \\ &-\Phi_{U_2} + \Phi_{U_2}G + G\Phi_{WX_3} = 0 \\ &G\cdot(\Phi_{U_2} + \Phi_{WX_1}) = \Phi_{U_2} \\ &G = \frac{\Phi_{U_2}}{\Phi_{U_2} + \Phi_{WX_1}} = \frac{\Phi_{U_2}}{\Phi_{X_2}} \end{aligned} \tag{11}$$

According to (12), we can substitute the energy of $X_2$ by the sum of the energies of the filtered version of $X_1$ and the uncorrelated signal $U_2$:

$$\begin{aligned} \Phi_{X_2} = E\{|X_2|^2\} = E\{(WX_1 + U_2)(WX_1 + U_2)^*\} = \\ E\{|WX_1|^2\}| + E\{|U_2|^2\} = \Phi_{WX_1} + \Phi_{U_2}. \end{aligned} \tag{12}$$

For the gains G, this leads to $$G = \frac{\Phi_{U_2}}{\Phi_{U_2} + \Phi_{WX_1}} = \frac{1}{1 + \frac{\Phi_{WX_1}}{\Phi_{U_2}}} = \frac{1}{1 + \underbrace{\frac{1}{SNR_{U_2(WX_1)}}}_{a\ priori\ SNR}}, \tag{13}$$

$$0 \le G \le 1$$

with $SNR_{U_2(WX_1)}$ being the a priori SNR of $X_2$. The complex filter gains W are determined using (6).

In one embodiment, the suppression module 10*b*, highlighted by the dashed gray rectangle in FIG. 5, can be replaced by a reverse phase-aligned suppression module 10' comprising a phase shift device 15 configured to align the phase of the second input signal $X_2$ to the phase of the first input signal $X_1$.

Figure 6:
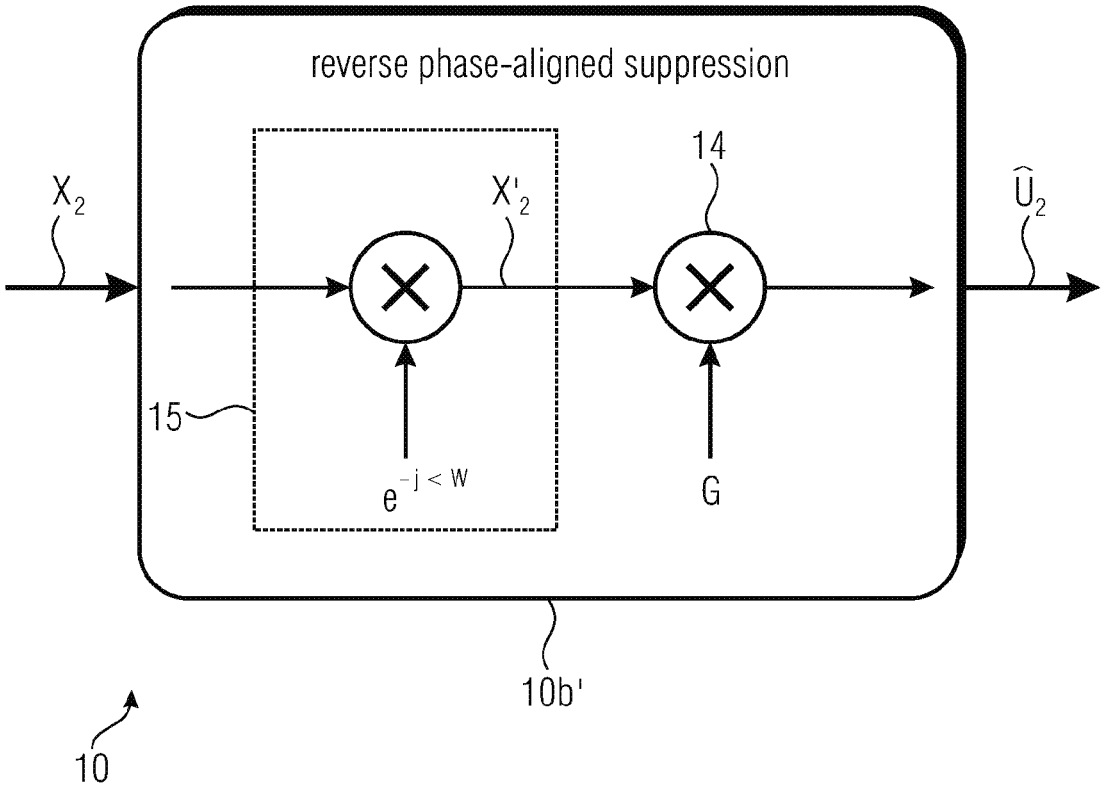
FIG. 6 illustrates a similarity reducer of a fourth embodiment.

FIG. 6 illustrates a similarity reducer 10*b'* having such phase shift device 15 as a fourth embodiment of the invention. The suppression gains G are real-valued and therefore have no influence on the phase relations of the two signals $X_1$ and $X_2$. But since the filter coefficients W have to be estimated anyway, additional information on the relative phase between the input signals may be gained. This information can be used to adjust the phase of $X_2$ towards the phase of $X_1$. This is done within the reverse phase-aligned suppression block 10*b'*; before the suppression gains G are applied, the phase of $X_2$ is shifted by the estimated phase of W. With a phase-alignment, the signal $\hat{U}_2$ can be expressed as $$\begin{aligned} \hat{U}_2 &= X_2 \cdot e^{-j\angle\hat{W}} \cdot G \\ &= (|W| \cdot e^{j(\angle W - \angle\hat{W})} X_1 + U_2 \cdot e^{-j\angle\hat{W}}) \cdot G, \end{aligned} \tag{14}$$

which shows that the residual component of $X_1$ within $\hat{U}_2$ is in phase with respect to $X_1$ provided that $\angle W$ is correctly estimated.

Figure 7:
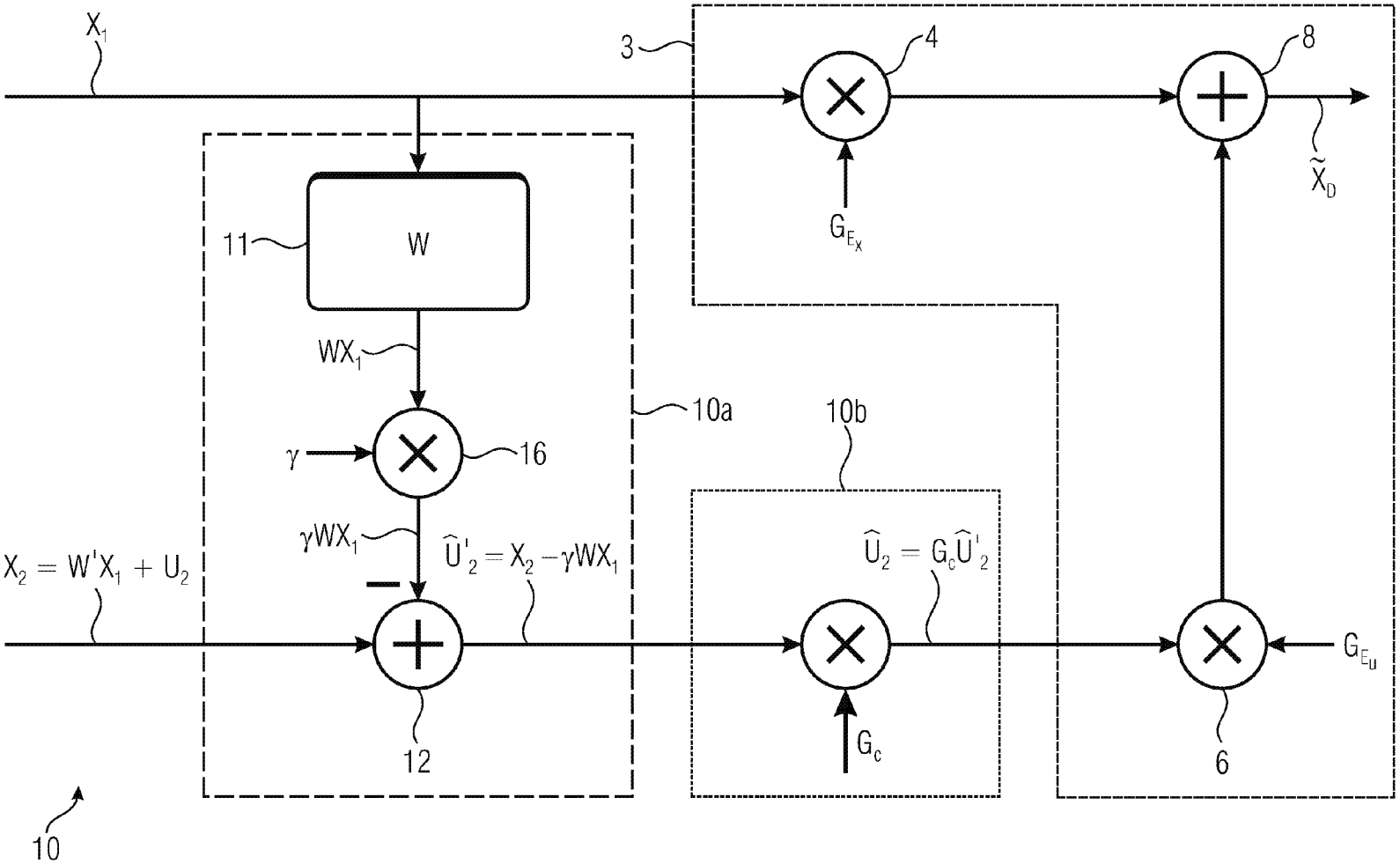
FIG. 7 illustrates a similarity reducer and a combiner of a fifth embodiment.

A combined approach of using canceling as well as suppression of coherent signal components is depicted in FIG. 7, wherein an output signal $\hat{U}'_2$.of the cancellation stage 10*a* is fed to an input of the signal suppression stage 10*b* in order to obtain the extracted signal $\hat{U}_2$. The cancelation stage 10*a* comprises a weighting device configured to weight the obtained signal parts $WX_1$ of the first input signal $X_1$ being present in the second input signal $X_2$).

Here, the resulting downmix signal$\tilde{X}_D$ is obtained by performing a weighted cancelation procedure, first, and afterwards applying a suppression gain. The resulting signal $\hat{U}_2$ as well as $X_1$. is energy scaled as before. Due to the weighting factor γ, the signal $\hat{U}'_2$ after the canceling stage still contains some signal parts correlated to $X_1$. To further reduce those signal parts, we derive the suppression gain $G_c$ for the combined approach:

$$G_c = \arg\min_{G_c} E\{|U_2 - \hat{U}_2|^2\},\ G_c \in \mathbb{R} \tag{15}$$

$$\begin{aligned} &J'(G_c) = \\ &E\{|U_2 - \hat{U}_2|^2\} = \Phi_{U_2} - G_c\Phi_{U_2} + (1-\gamma)^2 G_c^2 \Phi_{WX_1} - G_c\Phi_{U_2} + G_c^2\Phi_{U_2} \end{aligned} \tag{16}$$

$$\frac{\partial}{\partial G}J'(G_c) = -\Phi_{U_2} + 2(1-\gamma)^2 G_c \Phi_{WX_1} - \Phi_{U_2} + 2G_c\Phi_{U_2} \overset{!}{=} 0 \tag{17}$$

$$G_c = \frac{1}{1 + (1-\gamma)^2 \frac{\Phi_{WX_1}}{\Phi_{U_2}}} = \frac{1}{1 + (1-\gamma)^2 \frac{1}{SNR_{U_2 WX_1}}} \tag{18}$$

The parameter γ is in general time and frequency dependent but can also be chosen as constant. One possibility to determine a time and frequency depending γ is:

$$\gamma = 1 - \frac{|E\{X_2 X_1^*\}|}{\sqrt{\Phi_{X_1}\Phi_{X_2}}} \tag{19}$$

Figure 8:
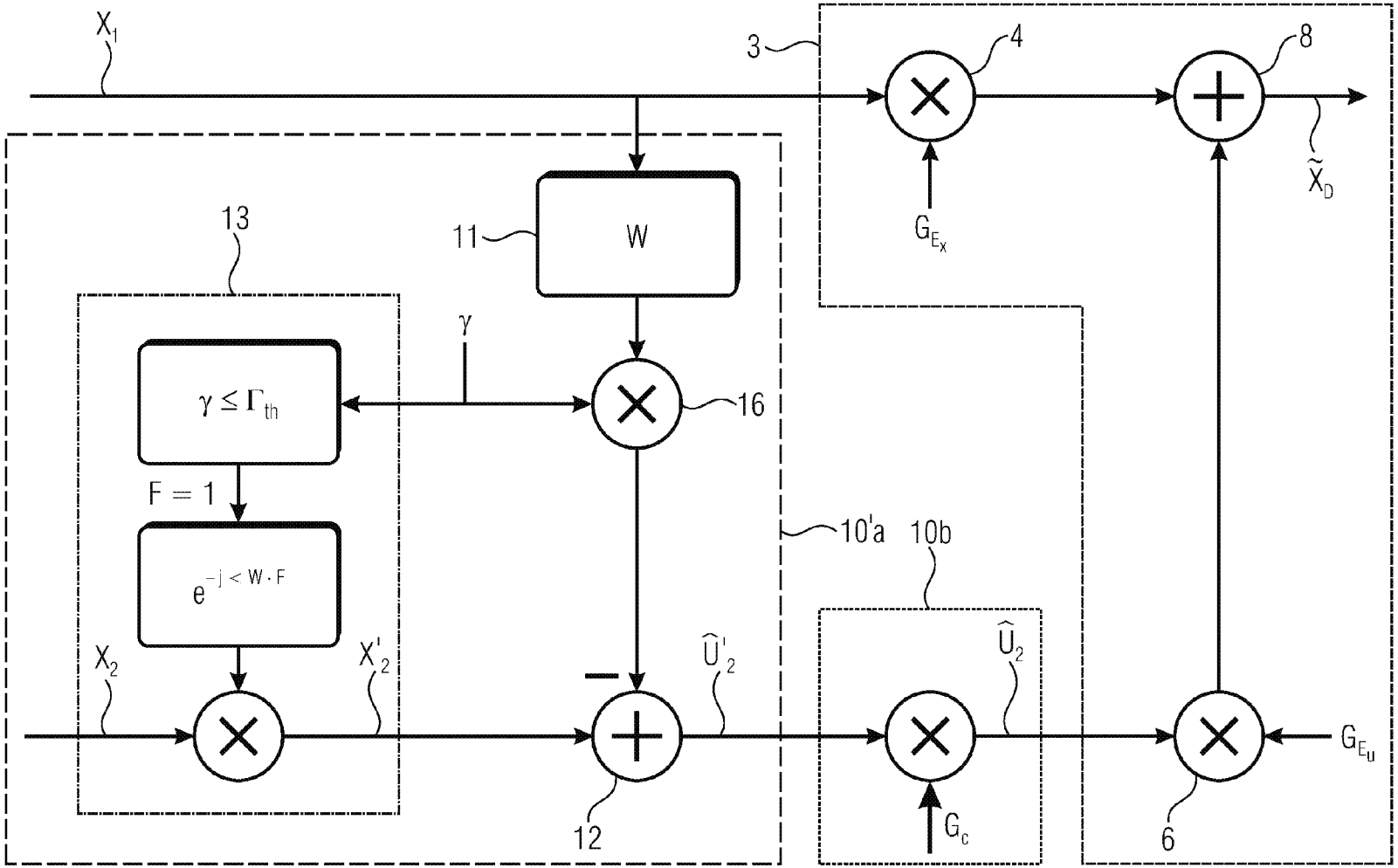
FIG. 8 illustrates a similarity reducer and a combiner of a sixth embodiment.

FIG. 8 illustrates a similarity reducer 10 and a combiner 3 of a sixth embodiment. According to this embodiment the normalized cross-correlation in (19) is fed as input to a mapping function whose output can be used to determine the actual γ-values. For the mapping, a logistic function can be used which can be defined as:

$$f(i) = A_l + \frac{A_u - A_l}{\left(1 + \left(-1 + \left(\frac{A_u}{Y_0}\right)^{\nu}\right) \cdot e^{-R(i+M)}\right)^{\frac{1}{\nu}}}, \tag{20}$$

where i defines the input data, $A_u$ and $A_l$ the upper and lower asymptote, R is the growth rate, ν>0 influences the maximum growth rate near the asymptote, $f_0$ specifies the output value for f(0) and M is the data point i of maximum growth. In such embodiment, γ is determined by $$\gamma = 1 - f\left(\frac{|E\{X_2 X_1^*\}|}{\sqrt{\Phi_{X_1}\Phi_{X_2}}} - 0.5\right) \tag{21}$$

In one embodiment, the reverse phase-aligned cancelation module 10*a'* can be used here as well with a small modification. The weighting with γ has to be done analogously after filtering with the absolute value of W.

A sixth embodiment shown in FIG. 8 comprises a more sophisticated application of the reverse phase processing. It affects only time-frequency bins which were mapped to mainly be suppressed, i.e. $\gamma$ is below a certain threshold $\Gamma_{th}$. For that reason, a flag F defined by $$F = \begin{cases} 1 & \gamma \leq \Gamma_{th} \\ 0 & \text{otherwise} \end{cases} \tag{22}$$

is introduced.

In one embodiment, the reverse phase-aligned cancelation module 10*a'* can be used here as well with a small modification. The weighting with $\gamma$ has to be done analogously after filtering with the absolute value of W.

In some embodiments the scale factor provider 7 provides $G_{E_x}$, by which the energy amount of the uncorrelated signal $\hat{U}_2$ with respect to $X_1$. contributing to the downmix signal $\tilde{X}_D$ can be controlled. These scale factors $G_{E_u}$ can be seen as an equalizer. In general, this is done frequency dependent and in an advantageous embodiment manually by a sound engineer. Of course, plenty of different mixing ratios are possible and these highly depend on the experience and/or taste of the sound engineer. Alternatively, the scale factors $G_{E_u}$ can be a function of the signals $X_1$, $X_2$ and $\hat{U}_2$.

In some embodiments the scale factor provider 4 provides $G_{E_x}$, by which the energy amount of the first input signal $X_1$ contributing to the downmix signal $\tilde{X}_D$ can be controlled. If the downmixing process ought to be energy preserving (i.e., the downmix signal contains the same amount of energy as the original stereo signal) or at least if the perceived sound level ought to stay the same, additional processing is necessitated. The following consideration is made with the objection to keep the perceived sound level of the individual signal parts in the downmix signal constant. In one embodiment, the energy is scaled according to a derived optimal-downmix-energy consideration. One may consider two signals $X_1^c$ and $X_2^c$ and assume them to be highly correlated as it would be the case, for instance, for an amplitude panned source with $E\{X_1^c X_2^{c*}\} \neq 0$. The signal $X_2^c$ can be expressed as $X_2^c = a \cdot X_1^c$ such that the downmix signal $X_D^c$ results in $$\begin{aligned} X_D^c &= X_1^c + X_2^c \\ &= X_1^c + a \cdot X_1^c \\ &= (1+a) \cdot X_1^c. \end{aligned} \tag{23}$$

The energy of $X_D^c$ is given by $$E\{|X_D^c|^2\} = (1+a)^2 \cdot E\{|X_1^c|^2\}. \tag{24}$$

We now assume the two signals to be fully uncorrelated with $E\{X_1^u X_2^{u*}\} = 0$. The downmix signal $X_D^c$ results in $$X_D^u = X_1^u = X_2^u. \tag{25}$$

The energy of $X_D^u$ is given by $$\begin{aligned} E\{|X_D^u|^2\} &= E\{|X_1^u|^2\} + E\{|X_2^u|^2\} \\ &= E\{|X_1^u|^2\} + b \cdot E\{|X_1^u|^2\} \\ &= (1+b) \cdot E\{|X_1^u|^2\}. \end{aligned} \tag{26}$$

From these considerations, one can see the energy of an optimal downmix of the correlated signal parts would result in $$E\{|X_{D_a}^c|^2\} = E\{|X_1|^2\} + E\{|WX_1|^2\}, \tag{27}$$

with W corresponding to a in (23) and for the uncorrelated signal parts, a simple addition of the energy has to be done. The final optimal downmix energy with respect to the assumed signal model and the desired downmix signal in (1) and (2) would then result in $$\begin{aligned} E\{|X_D^o|^2\} &= E\{|X_{D_o}^c|^2\} + E\{|U_2|^2\} \\ &= E\{|X_1|^2\} + E\{|WX_1|^2\} + E\{|U_2|^2\}. \end{aligned} \tag{28}$$

In order to make sure $X_D^o$ and $\tilde{X}_D$ contain the same amount of energy, we introduced the energy scaling factors $G_{E_x}$ and $G_{E_u}$, where the latter is provided by the scale factor provider U2. The actual downmix signal $\tilde{X}_D$ computes as $$\tilde{X}_D = G_{E_x} \cdot X_1 = G_{E_u} \cdot \hat{U}_2. \tag{29}$$

Given the optimal downmix energy and $G_{E_u}$, we can now derive $G_{E_x}$ as follows:

$$E\{|X_D^o|^2\} \stackrel{!}{=} E\{|\tilde{X}_D|^2\} \tag{30}$$

$$\Phi_{X_1} + \Phi_{WX_1} + \Phi_{U_2} = G_{E_x}^2 \cdot \Phi_{X_1} + G_{E_u}^2 \cdot \Phi_{\hat{U}_2} \tag{31}$$

$$\begin{aligned} G_{E_x} &= \sqrt{\frac{\Phi_{X_1} + \Phi_{WX_1} + \Phi_{U_2} - G_{E_u}^2 \cdot \Phi_{\hat{U}_2}}{\Phi_{X_1}}} \\ &= \sqrt{1 + \frac{\Phi_{WX_1}}{\Phi_{X_1}} + \frac{\Phi_{U_2}}{\Phi_{X_1}} - G_{E_u}^2 \frac{\Phi_{\hat{U}_2}}{\Phi_{X_1}}} \end{aligned} \tag{32}$$

With (12) the middle part of equation (32) is identified as $$\frac{\Phi_{WX_1}}{\Phi_{X_1}} + \frac{\Phi_{U_2}}{\Phi_{X_1}} = \frac{\Phi_{X_2}}{\Phi_{X_1}}$$

so it becomes $$G_{E_x} = \sqrt{1 + \frac{\Phi_{X_2}}{\Phi_{X_1}} - G_{E_u}^2 \frac{\Phi_{\hat{U}_2}}{\Phi_{X_1}}}. \tag{33}$$

Figure 9:
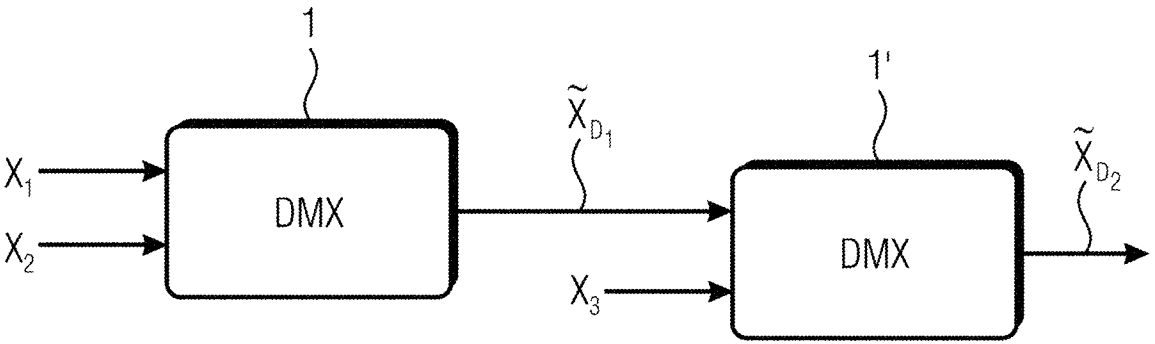
FIG. 9 illustrates a cascade of a plurality of audio signal processing device.

To downmix multiple input channels $X_1$, $X_2$, $X_3$, a cascade of multiple two-channel downmix stages 1 can be used. In FIG. 9, an example is shown for three input signals $X_1$, $X_2$, $X_3$.

The final downmix signal $\tilde{X}_{D_2}$ for a two staged system results in $$\begin{aligned} \tilde{X}_{D_2} &= G_{E_{\hat{X}_{D_1}}} \tilde{X}_{D_1} + G_{E_{U_3}} U_3 \\ &= G_{E_{\hat{X}_{D_1}}} \left(G_{E_{x_1}} X_1 + G_{E_{U_2}} U_2\right) + G_{E_{U_3}} U_3 \\ &= G_{E_{\hat{X}_{D_1}}} G_{E_{x_1}} X_1 + G_{E_{\hat{X}_{D_1}}} G_{E_{U_2}} U_2 + G_{E_{U_3}} U_3 \end{aligned} \tag{34}$$

Key-features of an embodiment of the invention are:

Considering $X_1$ as a reference signal and considering $X_2$ as a mixture of a filtered version of $X_1$, and therefore a correlated signal part $WX_1$ and an uncorrelated signal part $U_2$ with respect to $X_1$.

Separation/Decomposition of $X_2$ into its two afore-mentioned signal components. Dissimilarity extraction of $X_1$. and $X_2$ via estimation of the similarity of $X_1$. and $X_2$, which results in a filter coefficient W and similarity reduction either by cancelation or suppression of correlated signal parts or a combination of both, which results in an estimated uncorrelated signal part $\tilde{U}_2$.

Energy scaling of $\tilde{X}_1$ to meet a predefined energy level.

Energy scaling of $\tilde{U}_2$.

Summing up the energy scaled signals to form the desired downmix signal $\tilde{X}_D$.

Processing in frequency bands.

Optional implementation features are:

Reverse phase-aligned suppression or reverse phase-aligned cancelation.

Cascade of two or more downmix blocks to perform a multi-channel downmix.

Only partially applied reverse phase-aligned suppression.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention can be implemented in hardware or in software. The implementation can be performed using a non-transitory storage medium such as a digital storage medium, for example a floppy disc, a DVD, a Blu-Ray, a CD, a ROM, a PROM, and EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may, for example, be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive method is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the invention method is, therefore, a data stream or a sequence of signals representing the computer program for performing one of the methods described herein. The data stream or the sequence of signals may, for example, be configured to be transferred via a data communication connection, for example, via the internet.

A further embodiment comprises a processing means, for example, a computer or a programmable logic device, configured to, or adapted to, perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example, a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[1] ITU-R BS.775-2, "Multichannel Stereophonic Sound System With And Without Accompanying Picture," 07/2006.

[2] R. Dressler, (05.08.2004) Dolby Surround Pro Logic II Decoder Principles of Operation. [Online]. Available: http://www.dolby.com/uploadedFiles/Assets/US/Doc/Professional/209_Dolby_Surround_Pro_Logic_II_Decoder_Principles_of_Operation.pdf.

[3] K. Lopatka, B. Kunka, and A. Czyzewski, "Novel 5.1 Downmix Algorithm with Improved Dialogue Intelligibility," in 134th Convention of the AES, 2013.

[4] J. Breebaart, K. S. Chong, S. Disch, C. Faller, J. Herre, J. Hilpert, K. Kjörling, J. Koppens, K. Linzmeier, W. Oomen, H. Purnhagen, and J. Rödén, "MPEG Surround—the ISO/MPEG Standard for Efficient and Compatible Multi-Channel Audio Coding," J. Audio Eng. Soc, vol. 56, no. 11, pp. 932-955, 2007.

[5] M. Neuendorf, M. Multrus, N. Rellerbach, R. J. Fuchs Guillaume, J. Lecomte, Wilde Stefan, S. Bayer, S. Disch, C. Helmrich, R. Lefebvre, P. Gournay, B. Bessette, J. Lapierre, K. Kjörling, H. Purnhagen, L. Villemoes, W. Oomen, E. Schuijers, K. Kikuiri, T. Chinen, T. Norimatsu, C. K. Seng, E. Oh, M. Kim, S. Quackenbush, and B. Grill, "MPEG Unified Speech and Audio Coding—The ISO/MPEG Standard for High-Efficiency Audio Coding of all Content Types," J. Audio Eng. Soc, vol. 132nd Convention, 2012.

[6] C. Faller and F. Baumgarte, "Binaural Cue Coding-Part II: Schemes and Applications," Speech and Audio Processing, IEEE Transactions on, vol. 11, no. 6, pp. 520-531, 2003.

[7] F. Baumgarte, "Equalization for Audio Mixing," U.S. Pat. No. 7,039,204 B2, 2003.

[8] J. Thompson, A. Warner, and B. Smith, "An Active Multichannel Downmix Enhancement for Minimizing Spatial and Spectral Distortions," in 127nd Convention of the AES, October 2009.

[9] G. Stoll, J. Groh, M. Link, J. Deigmöller, B. Runow, M. Keil, R. Stoll, M. Stoll, and C. Stoll, "Method for Generating a Downward-Compatible Sound Format," US Patent US2012/0 014 526, 2012.

[10] B. Runow and J. Deigmöller, "Optimierter Stereo-Dowmix von 5.1-Mehrkanalproduktionen: An optimized Stereo-Downmix of a 5.1 multichannel audio production," in 25. Tonmeistertagung—VDT International Convention, 2008.

[11] Samsudin, E. Kurniawati, Ng Boon Poh, F. Sattar, and S. George, "A Stereo toMono Dowmixing Scheme for MPEG-4 Parametric Stereo Encoder," in Acoustics, Speech and Signal Processing, 2006. ICASSP 2006 Proceedings. 2006 IEEE International Conference on, vol. 5, 2006, p. V. 2.

[12] M. Kim, E. Oh, and H. Shim, "Stereo audio coding improved by phase parameters," in 129$^{th}$ Convention of the AES, 2010.

[13] W. Wu, L. Miao, Y. Lang, and D. Virette, "Parametric Stereo Coding Scheme with a New Downmix Method and Whole Band Inter Channel Time/Phase Differences," Acoustics, Speech and Signal Processing, IEEE Transactions on, pp. 556-560, 2013.

The invention claimed is:

1. An audio signal processing device for downmixing of a first input and a second input audio signals to a downmix audio signal, wherein the first input audio signal and the second input audio signal are at least partly correlated, comprising:

a dissimilarity extractor configured to receive the first input audio signal and the second input audio signal as well as to output an extracted audio signal, which is lesser correlated with respect to the first input audio signal than the second input audio signal and a combiner configured to combine the first input audio signal and the extracted audio signal in order to acquire the downmix audio signal, wherein the dissimilarity extractor comprises a similarity estimator configured to provide filter coefficients for acquiring audio signal parts of the first input audio signal being present in the second input audio signal from the first input audio signal, wherein the dissimilarity extractor comprises a similarity reducer configured to reduce the acquired audio signal parts from the first input audio signal being present in the second input audio signal based on the filter coefficients, wherein the similarity reducer comprises an audio signal suppression stage comprising an audio signal suppression device configured to multiply the second input audio signal or an audio signal derived from the second input audio signal with a suppression gain factor in order to acquire the extracted audio signal, wherein the suppression gain factor is chosen in such way that a mean squared error between the extracted audio signal and an audio signal part of the second input audio signal, which is uncorrelated with the first input audio signal, is minimized.

2. The audio signal processing device according to claim 1, wherein the combiner comprises an energy scaling system configured in such way that a ratio of an energy of the downmix and the summed up energies of the first input audio signal and the second input audio signal is independent from a correlation of the first input audio signal and the second input audio signal.

3. The audio signal processing device according to claim 2, wherein the energy scaling system comprises a first energy scaling device configured to scale the first input audio signal based on a first scale factor in order to acquire a scaled input audio signal.

4. The audio signal processing device according to claim 3, wherein the energy scaling system comprises a first scale factor provider configured to provide the first scale factor, wherein the first scale factor provider may be designed as a processor configured to calculate the first scale factor depending on the first input audio signal, the second input audio signal and/or the extracted audio signal.

5. The audio signal processing device according to claim 2, wherein the energy scaling system comprises a second energy scaling device configured to scale the extracted audio signal based on a second scale factor in order to acquire a scaled extracted audio signal.

6. The audio signal processing device according to claim 5, wherein the energy scaling system comprises a second scale factor provider configured to provide the second scale factor, wherein the second scale factor provider may be designed as a man-machine interface configured for manually inputting the second scale factor.

7. The audio signal processing device according to claim 1, wherein the combiner comprises a sum up device for outputting the downmix audio signal based on the first input audio signal and based on the extracted audio signal.

8. The audio signal processing device according to claim 1, wherein the similarity reducer comprises a cancelation stage comprising an audio signal cancellation device configured to subtract the acquired audio signal parts of the first input audio signal being present in the second input audio signal or an audio signal derived from the acquired audio signal parts from the second input audio signal or from an audio signal derived from the second input audio signal.

9. The audio signal processing device according to claim 8, wherein the cancelation stage comprises a complex filter device configured to filter the first input audio signal by using complex valued filter coefficients W.

10. The audio signal processing device according to claim 8, wherein the cancelation stage comprises a phase shift device configured to align a phase of the second input audio signal to a phase of the first input audio signal.

11. The audio signal processing device according to claim 10, wherein the phase shift device is configured to align the phase of the second input audio signal to the phase of the first input audio signal depending on the weighting factor.

12. The audio signal processing device according to claim 11, wherein the phase shift device is configured to align the phase of the second input audio signal to the phase of the first input audio signal only, if the weighting factor is smaller or equal to a predefined threshold.

13. The audio signal processing device according to claim 8, wherein an output audio signal of the cancelation stage is fed to an input of the audio signal suppression stage in order to acquire the extracted audio signal, or wherein an output audio signal of the audio signal suppression stage is fed to an input of the cancellation stage in order to acquire the extracted audio signal.

14. The audio signal processing device according to claim 13, wherein the cancelation stage comprises a weighting device configured to weight the acquired audio signal parts of the first input audio signal being present in the second input audio signal depending on a weighting factor.

15. The audio signal processing device according to claim 1, wherein the audio signal suppression stage comprises a phase shift device configured to align the phase of the second input audio signal to the phase of the first input audio signal.

16. An audio signal processing system for downmixing of a plurality of input audio signals to a downmix audio signal comprising at least a first audio signal processing device as the audio signal processing device according to claim 1 and a second audio signal processing device as the audio signal processing device according to claim 1, wherein the downmix audio signal of the first audio signal processing device is fed to the second audio signal processing device as a first input audio signal or as a second input audio signal.

17. A method for downmixing of a first input audio signal and a second input audio signal to a downmix audio signal comprising:

extracting an extracted audio signal from the second input audio signal, wherein the extracted audio signal is lesser correlated with respect to the first input audio signal than the second input audio signal summing up the first input audio signal and the extracted audio signal in order to acquire the downmix audio signal providing filter coefficients for acquiring audio signal parts of the first input audio signal being present in the second input audio signal from the first input audio signal, reducing the acquired audio signal parts from the first input audio signal being present in the second input audio signal based on the filter coefficients, multiplying the second input audio signal or an audio signal derived from the second input audio signal with a suppression gain factor in order to acquire the extracted audio signal, wherein the suppression gain factor is chosen in such way that a mean squared error between the extracted audio signal and an audio signal part of the second input audio signal, which is uncorrelated with the first input audio signal, is minimized.

18. A non-transitory digital storage medium having stored thereon a computer program for performing the method of claim 17 when said computer program is run by a computer.

* * * * *